US007352980B2

(12) United States Patent
Kato et al.

(10) Patent No.: US 7,352,980 B2
(45) Date of Patent: Apr. 1, 2008

(54) IMAGE FORMING APPARATUS AND METHOD INCLUDING POWER STATE SHIFT CONTROL

(75) Inventors: Kota Kato, Tokyo (JP); Yasuaki Sawano, Kawasaki (JP); Toshio Yoshihara, Kawasaki (JP); Yuuichi Hagiwara, Tokyo (JP); Ryotaro Imine, Kawasaki (JP); Shozo Yamasaki, Yokohama (JP); Makoto Kikugawa, Tokyo (JP); Eiji Ohara, Kawasaki (JP)

(73) Assignee: Canon Kabushiki Kaisha (JP)

( * ) Notice: Subject to any disclaimer, the term of this patent is extended or adjusted under 35 U.S.C. 154(b) by 261 days.

(21) Appl. No.: 11/197,311

(22) Filed: Aug. 5, 2005

(65) Prior Publication Data

US 2006/0029412 A1 Feb. 9, 2006

(30) Foreign Application Priority Data

Aug. 5, 2004 (JP) ..... 2004-229491

(51) Int. Cl.
*G03G 15/00* (2006.01)

(52) U.S. Cl. ..... 399/80; 399/79; 399/83

(58) Field of Classification Search ..... 399/75, 399/79, 80, 83
See application file for complete search history.

(56) References Cited

U.S. PATENT DOCUMENTS 5,701,548 A * 12/1997 Okatani ..... 399/8
6,334,719 B1 * 1/2002 Kimura ..... 400/54
7,064,854 B2 * 6/2006 Idehara ..... 399/70
7,142,122 B2 * 11/2006 Butikofer et al. ..... 399/75
2003/0053111 A1 3/2003 Endo

FOREIGN PATENT DOCUMENTS

JP 2002-157040 5/2002
JP 2003-122616 A 4/2003
JP 2003-195986 7/2003
JP 2003-317072 A 11/2003
JP 2007049308 A * 2/2007

* cited by examiner

*Primary Examiner*—David M. Gray
*Assistant Examiner*—Ryan D. Walsh
(74) *Attorney, Agent, or Firm*—Rossi, Kimms & McDowell LLP

(57) ABSTRACT

An image forming apparatus which is capable of achieving both enhanced userfriendliness and improved energy saving efficiency without being released from a reduced power consumption state by a user who has no will to use the same passing thereby. When a copying machine 200 is in a sleep mode, it is detected whether or not a user has come near to the copying machine 200. If a contactless IC 600 is present within the range of radio wave signals emitted from an IC tag reader/writer 500, it is determined that a user has come near because the communication between the contactless IC 600 and the IC tag reader/write 500 can be carried out. Reading of data from the contactless IC 600 is started, and user authentication is executed based on the data. If, as a result of the user authentication, the user is a licensed user, it is determined whether or not an original document has been set on an automatic feeder 800. When an original document has been set on the automatic feeder 800, the copying machine 200 is caused to return to a normal mode as a normal power consumption state from the sleep mode.

11 Claims, 12 Drawing Sheets

*FIG. 9*

| DETECTED RESULT OF USER OPERATION | | RESULT OF USER AUTHENTICATION | |
|---|---|---|---|
| | | LICENSED | UNLICENSED |
| OPERATED | | RETURN FROM SLEEP | DO NOT RETURN FROM SLEEP |
| NOT OPERATED | | DO NOT RETURN FROM SLEEP | DO NOT RETURN FROM SLEEP |

IMAGE FORMING APPARATUS AND METHOD INCLUDING POWER STATE SHIFT CONTROL

BACKGROUND OF THE INVENTION

1. Field of the Invention

The present invention relates to an image forming apparatus having a function of controlling return from a reduced power consumption state into which the apparatus shifts when not used, a control method therefor, an image forming system, and a program for implementing the control method.

2. Description of the Related Art

Conventionally, there has been known a security system which identifies users which use a plurality of user terminals (personal computers) arranged in an indoor environment or a field environment and permits only the authenticated users to use their terminals (for instance, Japanese Laid-Open Patent Publication (Kokai) No. 2002-157040). In such a security system, when a user comes near to a user terminal, communication is carried out between a communication apparatus located near the user terminal and a radio frequency identification (RFID) tag carried by the user, so that the user terminal is automatically activated (powered on) and the user is automatically authenticated, to thereby improve userfriendliness.

However, when the above conventional security system is applied to an image forming apparatus, when any of a plurality of users authorized (licensed) to use the image forming apparatus merely passes thereby, the image forming apparatus returns from a sleep mode as the reduced power consumption state. As a result, each time a user, who actually has no will to use the image forming apparatus, passes thereby, it returns from the reduced power consumption state, leading to degraded energy saving efficiency.

SUMMARY OF THE INVENTION

It is an object of the present invention to provide an image forming apparatus, a control method therefor, and an image forming system, which are capable of preventing the image forming apparatus from being released from a reduced power consumption state by a user who has no will to use the same passing thereby, to achieve both enhanced userfriendliness and improved energy saving efficiency, as well as a program for implementing the control method.

More specifically, the present invention aims to enhance userfriendliness by using a wireless communication based authentication system in a user authentication-based security environment, and improve energy saving efficiency by enabling the image forming apparatus to return from the reduced power consumption state only when a user is apparently willing to use the image forming apparatus, to thereby achieve both enhanced userfriendliness and improved energy saving efficiency.

To attain the above object, in a first aspect of the present invention, there is provided an image forming apparatus that controls shift from a reduced power consumption state, comprising an information reading unit that is operable when a portable information storage unit owned by a user is present within a predetermined range, to communicate with the portable information storage unit to read information stored in the portable information storage unit, an authentication unit that executes authentication of the user based on the read information, an operation detecting unit that detects the user's operation of the image forming apparatus based on a predetermined action of the user, and a control unit that controls the shift from the reduced power consumption state when the user is authenticated and the user's operation of the image forming apparatus is detected.

Preferably, the control unit causes the image forming apparatus to shift to a normal power consumption state into which the image forming apparatus shifts when used, from the reduced power consumption state.

Preferably, the image forming apparatus comprises a presence detecting unit that detects whether or not the portable information storage unit owned by the user is present within the predetermined range, and the information reading unit communicates with the portable information storage unit when the portable information storage unit is present in the predetermined range.

Preferably, the control unit controls the shift from the reduced power consumption state by using a table indicating control contents corresponding to results of the authentication of the user and results of the detection of the user's operation.

Also preferably, the image forming apparatus comprises a document feeder that feeds an original document to a read position, the document feeder having a tray, and the operation detecting unit confirms the user's operation when detecting that the original document has been set on the tray of the document feeder.

Preferably, the image forming apparatus comprises an input unit that inputs a user's operation, and the operation detecting unit confirms the user's operation when detecting that an operation by the user has been input by the input unit.

Also preferably, the image forming apparatus comprises a measuring unit that measures a period of time for which the presence detecting unit has consecutively detected that the portable information storage unit is present within the predetermined range, and wherein the operation detecting unit confirms the user's operation when the period of time measured by the measuring unit reaches a predetermined period of time.

To attain the above object, in a second aspect of the present invention, there is provided a control method of controlling shift of an image forming apparatus from a reduced power consumption state, comprising an information reading step of communicating with a portable information storage unit owned by a user to read information stored in the portable information storage unit when the portable information storage unit is present within a predetermined range, an authentication step of executing authentication of the user based on the read information, an operation detecting step of detecting the user's operation of the image forming apparatus based on a predetermined action of the user, and a control step of controlling the shift from the reduced power consumption state when the user is authenticated and the user's operation of the image forming apparatus is detected.

To attain the above object, in a third aspect of the present invention, there is provided an image forming system comprising an image forming apparatus and a portable information storage unit owned by a user, that communicates with the imaging forming apparatus, the image forming system controlling shift of the image forming apparatus from a reduced power consumption state, and wherein the image forming apparatus comprises a presence detecting device that detects whether or not the portable information storage unit owned by the user is present within a predetermined range, an information reading device that communicates with the portable information storage unit to read information stored in the portable information storage unit when the portable information storage unit is present within the predetermined range, an authentication device that executes authentication of the user based on the read information, an operation detecting unit that detects the user's operation of the image forming apparatus based on a predetermined action of the user, and a control device that controls the shift from the reduced power consumption state when the user is authenticated and the user's operation of the image forming apparatus is detected, and wherein the portable information storage unit comprises an information storage device that stores information therein, and a transmitting device that communicates with the image forming apparatus to transmit the stored information to the image forming apparatus.

To attain the above object, in a fourth aspect of the present invention, there is provided a storage medium storing a computer-readable program code that realizes the control method according to the second aspect of the present invention.

To attain the above object, in a fifth aspect of the present invention, there is provided a program comprising a computer readable program code that realizes the control method according to the second aspect of the present invention.

To attain the above object, in a sixth aspect of the present invention, there is provided an image forming apparatus that controls shift from a reduced power consumption state, comprising an information reading unit that is operable when a portable information storage unit owned by a user is present within a predetermined range, to communicate with the portable information storage unit to read information stored in the portable information storage unit, an authentication unit that executes authentication of the user based on the read information, an operation detecting unit that detects the user's operation of the image forming apparatus based on a predetermined action of the user, and a control unit that controls the shift from the reduced power consumption state based on a result of the authentication and a result of the detection of the user's operation.

To attain the above object, in a seventh aspect of the present invention, there is provided a control method of controlling shift of an image forming apparatus from a reduced power consumption state, from the reduced power consumption state, comprising an information reading step of communicating with a portable information storage unit owned by a user to read information stored in the portable information storage unit when the portable information storage unit is present within a predetermined range, an authentication step of executing authentication of the user based on the read information, an operation detecting step of detecting the user's operation of the image forming apparatus based on a predetermined action of the user, and a control step of controlling the shift from the reduced power consumption state based on a result of the authentication and a result of the detection of the user's operation.

To attain the above object, in an eighth aspect of the present invention, there is provided an image forming system comprising an image forming apparatus and a portable information storage unit owned by a user, that communicates with the imaging forming apparatus, the image forming system controlling shift of the image forming apparatus from a reduced power consumption state, and wherein the image forming apparatus comprises a presence detecting device that detects whether or not the portable information storage unit owned by the user is present within a predetermined range, an information reading device that communicates with the portable information storage unit to read information stored in the portable information storage unit when the portable information storage unit is present within the predetermined range, an authentication device that executes authentication of the user based on the read information, an operation detecting unit that detects the user's operation of the image forming apparatus based on a predetermined action of the user, and a control device that controls the shift from the reduced power consumption state based on a result of the authentication and a result of the detection of user's operation, and wherein the portable information storage unit comprises an information storage device that stores information therein, and a transmitting device that communicates with the image forming apparatus to transmit the stored information to the image forming apparatus.

According to the above configuration of the first aspect of the present invention, when a portable information storage unit owned by a user is present within a predetermined range, communication with the portable information storage unit is carried out to read information stored in the portable information storage unit, and user authentication based on the read information is executed. Further, the user's operation of the copying machine is detected. Further, shift of the image forming apparatus from a reduced power consumption state is controlled based on a result of the user authentication and a result of the detection of the user's operation the copying machine. As a result it is possible to prevent the image forming apparatus from being released from a reduced power consumption state by a user who has no will to use the same passing thereby, to thereby achieve both enhanced userfriendliness and improved energy saving efficiency.

Further, according to the above configuration, since the image forming apparatus detects that a user has come near to the image forming apparatus, this enables the image forming apparatus itself to control the mode shift. In addition, the mode shift control can be realized in various ways by setting a plurality of specific mode shift conditions including shift of a part or component of the image forming apparatus from the reduced power consumption state, as in the case where the use of a certain part or component of the apparatus is restricted.

Moreover, according to the above configuration, a user's operation the image forming apparatus is confirmed based on the fact that the user has set an original document, and hence the image forming apparatus or system can be shifted from the reduced power consumption state only when the user is sure to use the image forming apparatus or system. Further, since a user's operation the image forming apparatus is confirmed based on the fact that the user has operated the operating section of the image forming apparatus, the image forming apparatus or system can be shifted from the reduced power consumption state only when the user is sure to use the image forming apparatus or system.

The above and other objects, features, and advantages of the invention will become more apparent from the following detailed description taken in conjunction with the accompanying drawings.

BRIEF DESCRIPTION OF THE DRAWINGS

FIG. 9 is a diagram showing a matrix table showing conditions for the copying machine to return from a sleep mode;

DETAILED DESCRIPTION OF THE PREFERRED EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless they are specifically stated otherwise.

An image forming apparatus and an image forming apparatus according to a first embodiment of the present invention will be described. The image forming apparatus according to the present embodiment is applied to a copying machine as a multifunction peripheral (MFP).

(Arrangement of Image Forming System)

Figure 1:
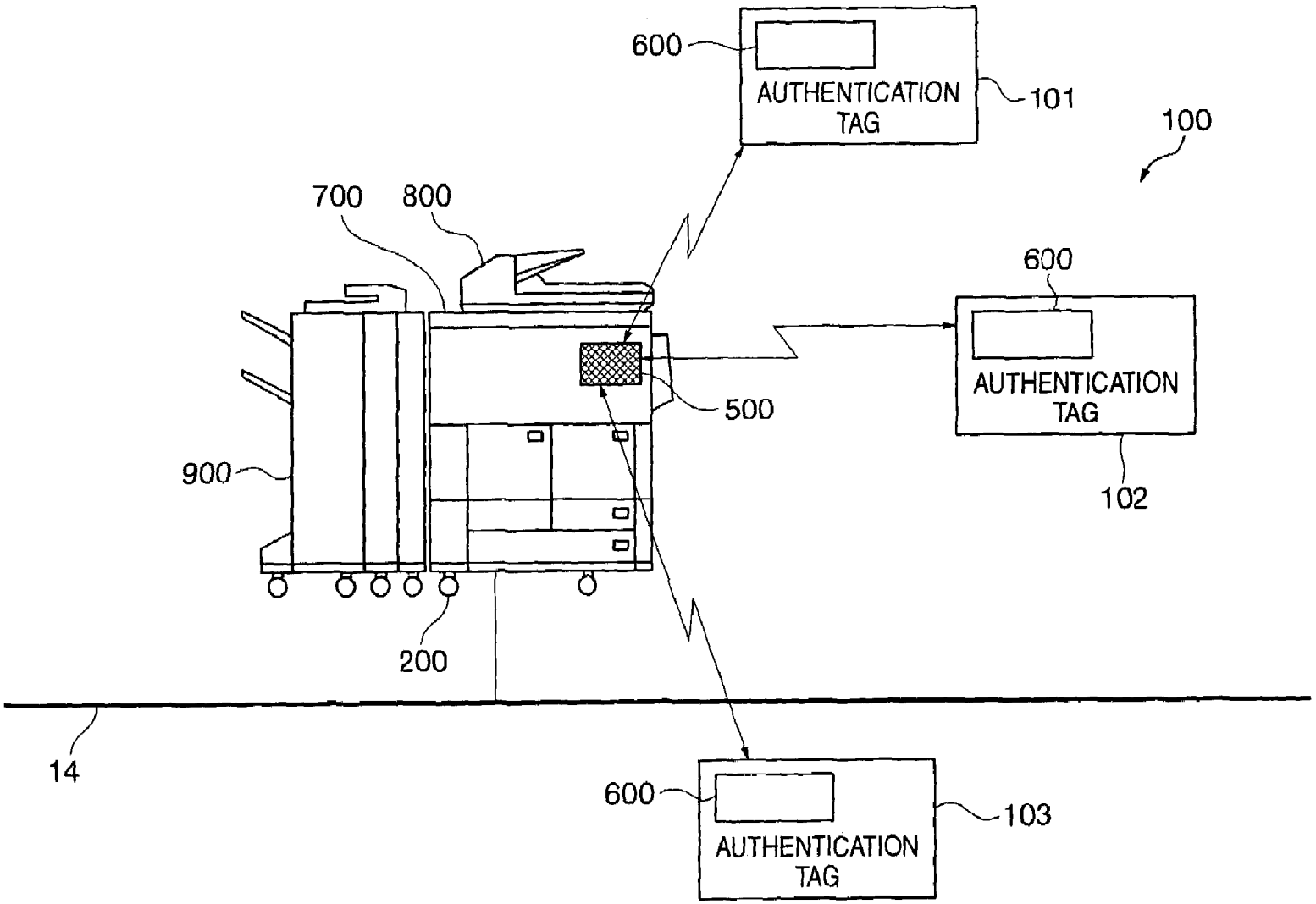
FIG. 1 is a block diagram showing the arrangement of an image forming system according to a first embodiment of the invention.

FIG. 1 is a block diagram showing the arrangement of the image forming system according to the first embodiment. As shown in FIG. 1, the image forming system 100 is comprised of a copying machine 200 connected to a network 14, and authentication tags (ID cards) 101 to 103 owned by users.

The copying machine 200 reads original images, and records image data thereof on a recording medium such as a paper sheet. An automatic feeder (document feeder) 800 is mounted on an upper portion of the body of the copying machine 200. A sheet finisher 900 is attached to a side of the body of the copying machine 200 and performs post-processing on recorded sheets discharged from the copying machine 200. An operating panel 700 which is operated by a user is provided on an upper front portion of the body of the copying machine 200. Details of the operating panel 700 will be described later.

An IC tag reader/writer 500 is provided in a front portion of the body of the copying machine 200 and reads and writes information into and from contactless ICs incorporated in the authentication tags 101 to 103. Each contactless IC 600 called IC tag has provided therein a wireless communication function and a memory and is thus able to store information in the memory, as described below.

In the present embodiment, the authentication tags 101 to 103, which are owned by respective users, are implemented as ID cards. As stated above, each authentication tag 101 to 103 incorporates a contactless IC 600 therein, and if a user carrying such an authentication tag passes by the copying machine 200, that is, if a contactless IC 600 in any of the authentication tags is present within the range of radio wave signals emitted from the IC tag reader/writer 500, then communication is carried out between the contactless IC 600 and the IC tag reader/writer 500. The copying machine 200 has a user authentication function, and when a user carrying his authentication tag 100 to 103 passes by the copying machine 200, communication is carried out between the contactless IC 600 and the IC tag reader/writer 500 to execute the user authentication by the copying machine 200.

In the case where a user uses the automatic feeder 800 to make a copy, a document set signal, which is generated by the automatic feeder 800 when an original document has been set the automatic feeder 800, is sent to the copying machine 200 from the automatic feeder 800 to notify the CPU 301 of the user's will to operate the copying machine 200 with which the user "has set an original document on the automatic feeder 800". Thus, the copying machine 200 detects the user's operation when receiving the signal.

When the copying machine 200 is not used, it shifts into a sleep mode, i.e. a reduced power consumption state. For example, when the copying machine 200 has not been used over a predetermined period of time, it automatically shifts into the sleep mode. On the other hand, conditions for returning from the sleep mode (returning from a sleep state) are shown in a matrix table (see FIG. 9), which will be described later. That is, only when a user is determined to be a "licensed" user as a result of the user authentication, and at the same time the user's operation has been detected, the copying machine 200 is returned from the sleep mode into a normal mode as a normal power consumption state where the copying machine 200 is in use.

(Construction of Copy Machine 200)

Figure 2:
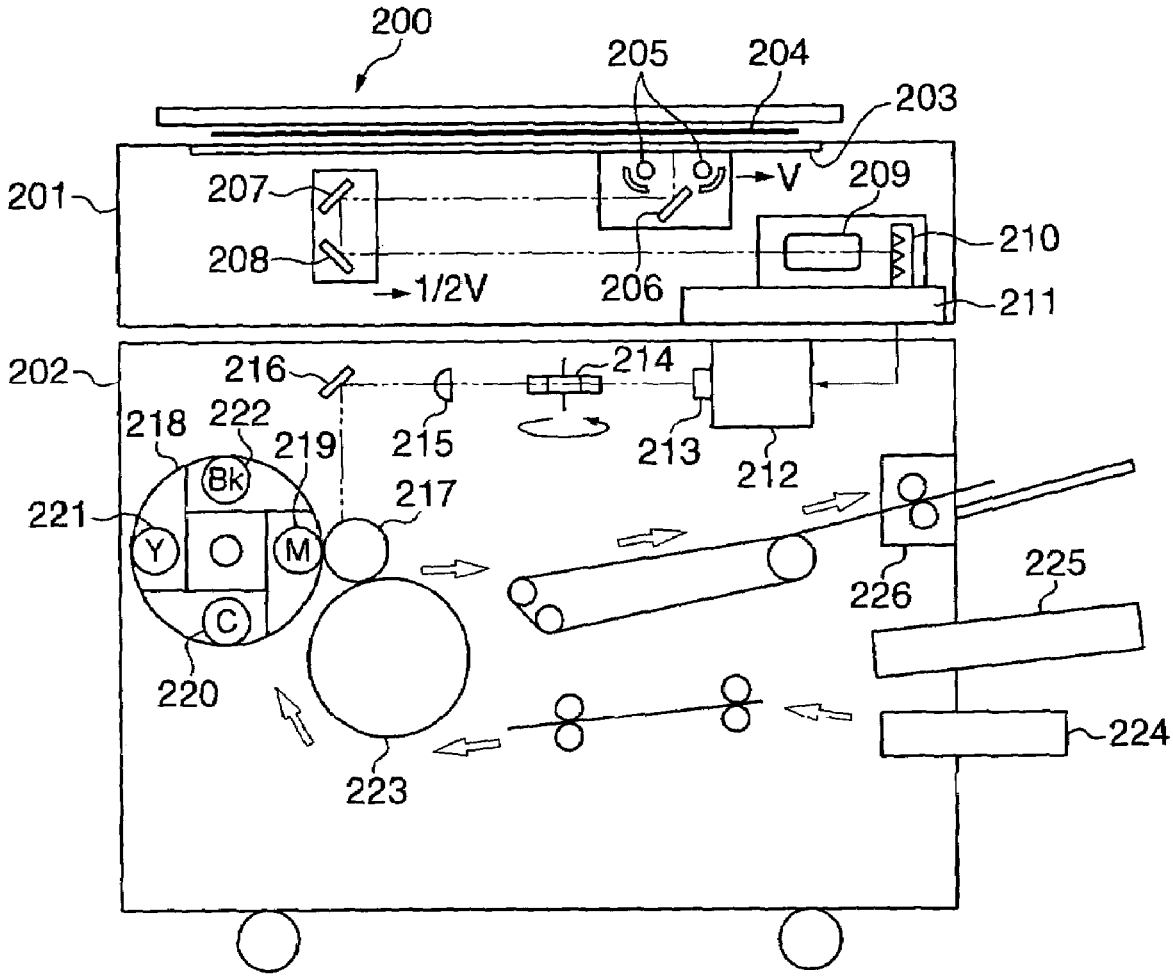
FIG. 2 is a view showing the internal construction of a copying machine appearing in FIG. 1.

FIG. 2 is a view showing the internal construction of the copying machine 200 in FIG. 1. In FIG. 2, the sheet finisher 900 and the automatic feeder 800 have been removed, and a platen is placed in place of the automatic feeder 800. The copying machine 200 is comprised of an image reader section 201 for reading the original image, and a printer section 202 for reproducing an image from image data obtained by reading by the image reader section 201. The image reader section (also referred to simply as the reader or scanner) 201 reads an original image at a resolution of 400 dots/inch (dpi) and performs digital signal processing on the read original image. The printer section 202 prints, in full color and at a resolution of 1200 dpi, an image corresponding to the read original image on a designated sheet.

In the image reader section 201, when an original document 204 on a platen glass (platen) 203 is illuminated by lamps 205, light reflected from the sheet 204 is guided by mirrors 206, 207 and 208 and focused into an optical image by a lens 209 on three line sensors (CCD) which convert the focused light into electric signals and send the signals as red (R), green (G), and blue (B) components representing full color information to a signal processing section 211. It should be noted that a carriage on which the lamps 205 and the mirror 206 are fixed moves in a direction perpendicular to the direction of electrical scanning (main scanning) by the line sensors at a velocity v, and the mirrors 207 and 208 move at a velocity ½ v, whereby the entire surface of the original document is scanned (sub-scanned).

The scanned or read image data is temporarily stored in a memory. Next, when the stored image data is read out from the memory, the signal processing section 211 processes the read image data to decompose the same into magenta (M), cyan (C), yellow (Y), and black (Bk) component signals, and supplies the component signals to the printer section 202.

Alternatively, it may be configured such that for each scan operation of the image reader section 201 with respect to an original document, a component image signal associated with one of the components M, C, Y, Bk is supplied to the printer section 202 so that repeating the process of scanning the original document four times will result in a single page of printout. The component image signals M, C, Y, and Bk received from the image reader section 201 are transferred to a laser driver 212.

The laser driver 212 a semiconductor laser 213 to modulate output laser thereof according to the received image signals. The modulated laser light is transmitted through a polygon mirror 214, an f-θ lens 215, and a mirror 216 to scan over a photosensitive drum 217. A rotating developing device 218 is comprised of a magenta developing section 219, a cyan developing section 220, a yellow developing section 221 and a black developing section 222. These four developing sections are cyclically brought into contact with the photosensitive drum 217, to thereby develop latent images formed on the photosensitive drum 217 with toners.

A recording sheet fed from a sheet cassette 224 or 225 is wound around an outer surface of a transfer drum 223, and images developed on the photosensitive drum 217 are transferred onto the sheet on the transfer drum 223. After the toner images of four colors M, C, Y and Bk are successively transferred in this way, the sheet is fed to a fixing device 226 where the toners on the sheet are fixed thereon, and then the sheet is discharged.

(Automatic Feeder 800)

Figure 3:
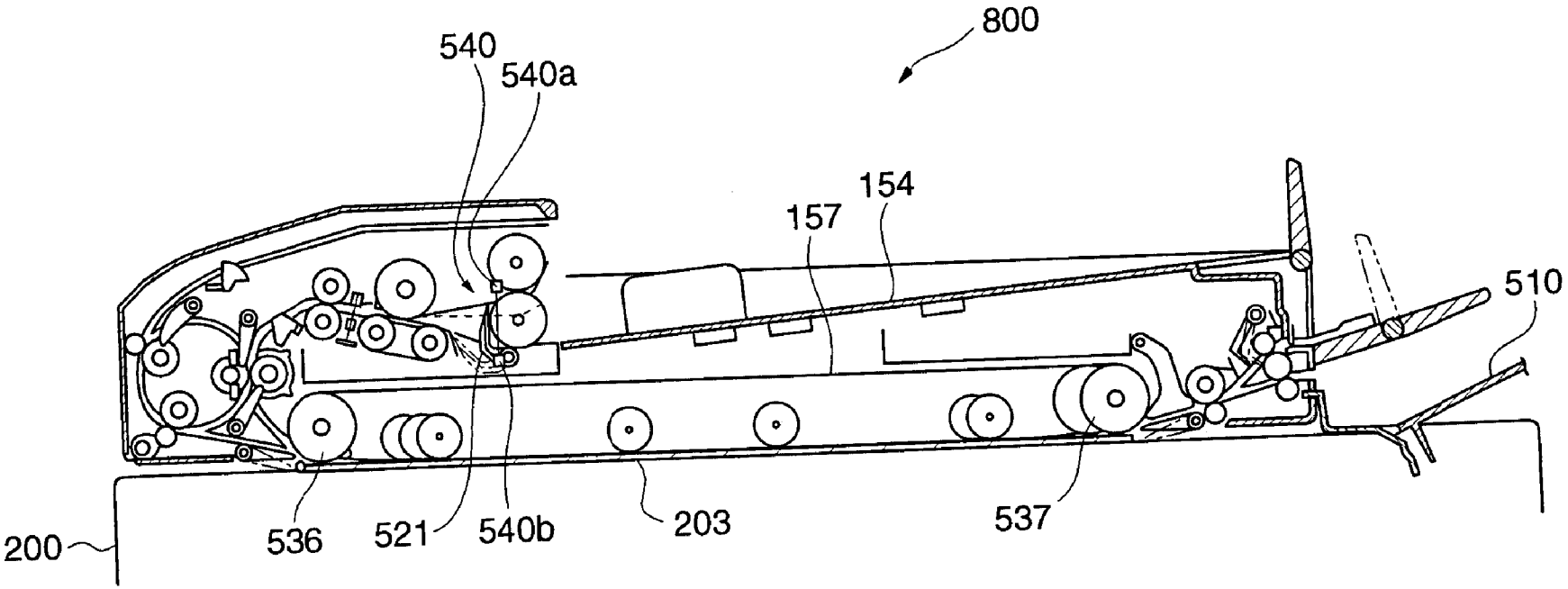
FIG. 3 is a view showing the internal construction of an automatic feeder appearing in FIG. 1.

FIG. 3 is a view showing the internal construction of the automatic feeder 800 in FIG. 1. The automatic feeder 800 transfers an original document to a predetermined read position of the image reader section 201. The automatic feeder 800 has, at an upper portion thereof, an original tray 154 on which an original document is to be placed, and has, below the original tray 154, a wide belt 157 which is wound around a drive roller 536 and a turn roller 537. Original documents P stacked on the original tray 154 are separated one from others starting with upper documents and fed onto the platen glass (platen) 203 as the read position of the image reader section 201. The wide belt 157, which is in abutment with the platen 203, places an original document P fed from the original tray 154 on the platen 203 at a predetermined position thereof, and sends the original document P placed on the platen 203 to a discharge tray 510.

The original tray 154 has sheet-like original documents stacked thereon. A stopper 521 is rotatably provided at a downstream end of the original tray 154 in the document feeding direction so that the protruded stopper 521 prevents the original documents P set on the original tray 154 from being moved forward in the downstream direction. A document set sensor 540 (540*a*, 540*b*) formed of a transmission type photo sensor is provided just upstream of the stopper 521 to detect that a bundle of sheet-like original documents P has been set the original tray 154. A detection signal (document set signal) from the document set sensor 540 is sent to the image reader section 201, which will be described later.

(Operating Panel 700)

Figure 4A:
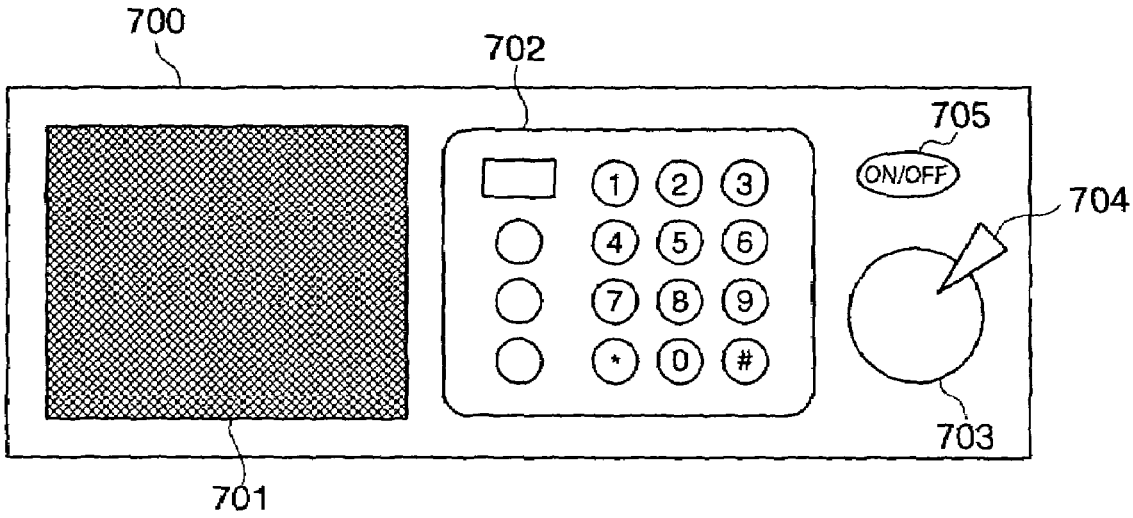
FIGS. 4A and 4B are views showing an operating panel appearing in FIG. 1.
Figure 4B:
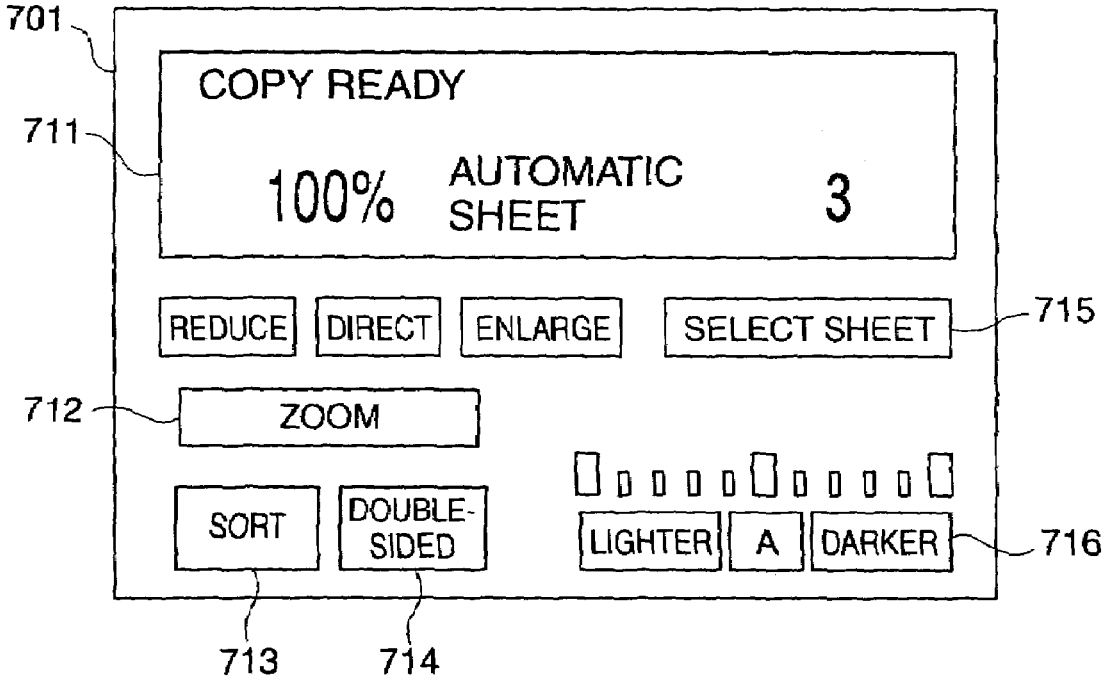

FIGS. 4A and 4B are views showing the operating panel 100 in FIG. 1. FIG. 4A shows the entire operating panel 700. A liquid crystal operating panel 701, a hardware key group 702, a power key 705, a start key 703, a stop key 704, etc. are arranged on the operating panel 700. The liquid crystal operating panel 701 is a combination of a liquid crystal display and a touch panel, and displays contents of settings, software keys, etc.

The hard key group 702 includes numeric keys, a clear key, a reset key, a guide key, and a user mode key. The start key is a hardware key used to enter a start command for operations such as a copy operation, and has green and red LEDs embedded therein. The green LED is lit when the start is enabled, and the red LED is lit when the start is disabled. The stop key 704 is a hardware key used to stop the operation. The power key 705 is a hardware key used to turn on/off the power supply of the copying machine 200.

FIG. 4B shows a screen of the liquid crystal operating panel 701. Displayed on the liquid crystal operation 701 is a normal copy screen having a setting display section 711, and software keys arranged thereon. The setting display section 711 displays the current operative state of the copying machine 200, the currently magnification, the currently set sheet type, the currently set number of copies, etc. A magnification software key group 712 includes a direct key, an enlarge key, a reduce key, and a zoom key, as software keys of the magnification of the copy. A sorter key 713 is used to designate a method of processing output sheets.

A double-sided key 714 is used to designate double-sided printing. A select sheet key 715 is used to change the screen to a screen for designating size, color, material, etc. of the output sheet. A density key group 716 is used to adjust the density of a read image or an output image, as well as to display setting contents.

(Electrical Construction of Image Reader Section 201)

Figure 5:
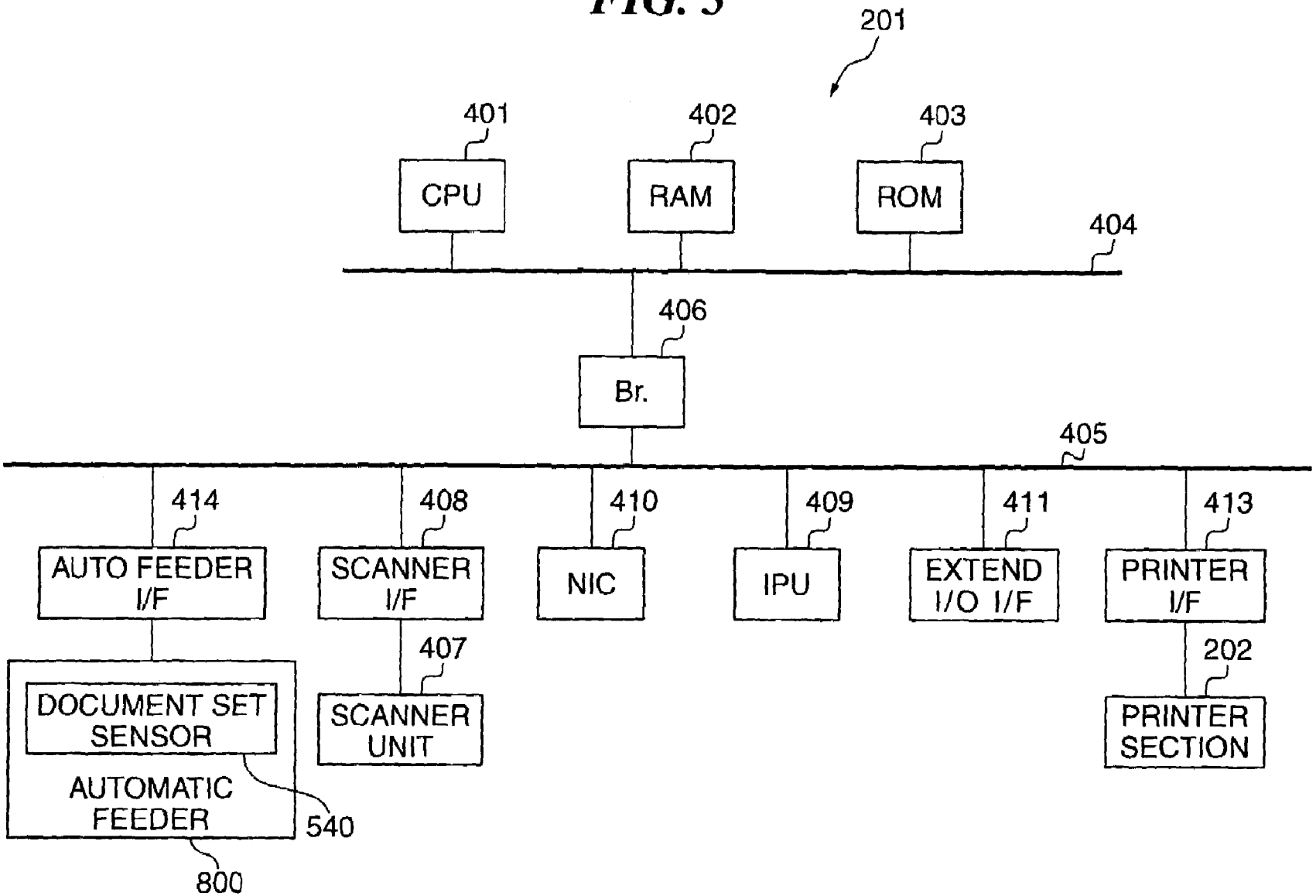
FIG. 5 is a block diagram showing the electrical construction of an image reader section appearing in FIG. 2.

FIG. 5 is a block diagram showing the electrical construction of the image reader section 201 in FIG. 2. The image reader section 201 includes a local bus 404 and an I/O bus 405 connected to each other via a bridge circuit 406. Well-known components such as a CPU 401, a RAM 402, and a ROM 403 are connected to the local bus 404. The I/O bus 405 is an internal bus for extensions. Connected to the I/O bus 405 are a network interface controller (NIC) 410, an image processing unit (IPU) 409, a scanner interface 408, an expansion I/O interface 411, a printer interface 413, an automatic feeder interface 414, etc.

The CPU 401 controls respective components of the image reader section 201. The RAM 402 temporarily stores results of computations by the CPU 401, image data read by the image reader section 201, etc. The ROM 403 stores programs to be executed by the CPU 401, and the like.

The scanner unit 407 converts an optical signal read from an original document set on the platen into electronic data by means of CCDs or the like, and transfers the electronic data to the scanner interface 408. The scanner interface 408 provides connection between the scanner unit 407 and the I/O bus 405, and transfers read image data of an original document sent from the scanner unit 407 to the RAM 402 according to an instruction from the CPU 401. The network interface controller 410 is used to connect the image reader section 201 to the network 14. The image processing unit (IPU) 409 performs image processing such as resolution conversion, and constitutes the above described signal processing section 211. The expansion I/O interface 411 is an interface circuit used for the CPU 401 to communicate with, for example, a portable device. The communication method includes a serial communication interface, a bidirectional Centronics interface, or a wireless communication method such as Bluetooth.

The printer interface 413, to which is connected the printer section 202, is used to transfer image data stored in the RAM 402 and various signals to the printer section 202. Connected to the automatic feeder interface 414 are the document set sensor 540 and other components in the automatic feeder 800.

(Electrical Construction of Printer Section 202)

Figure 6:
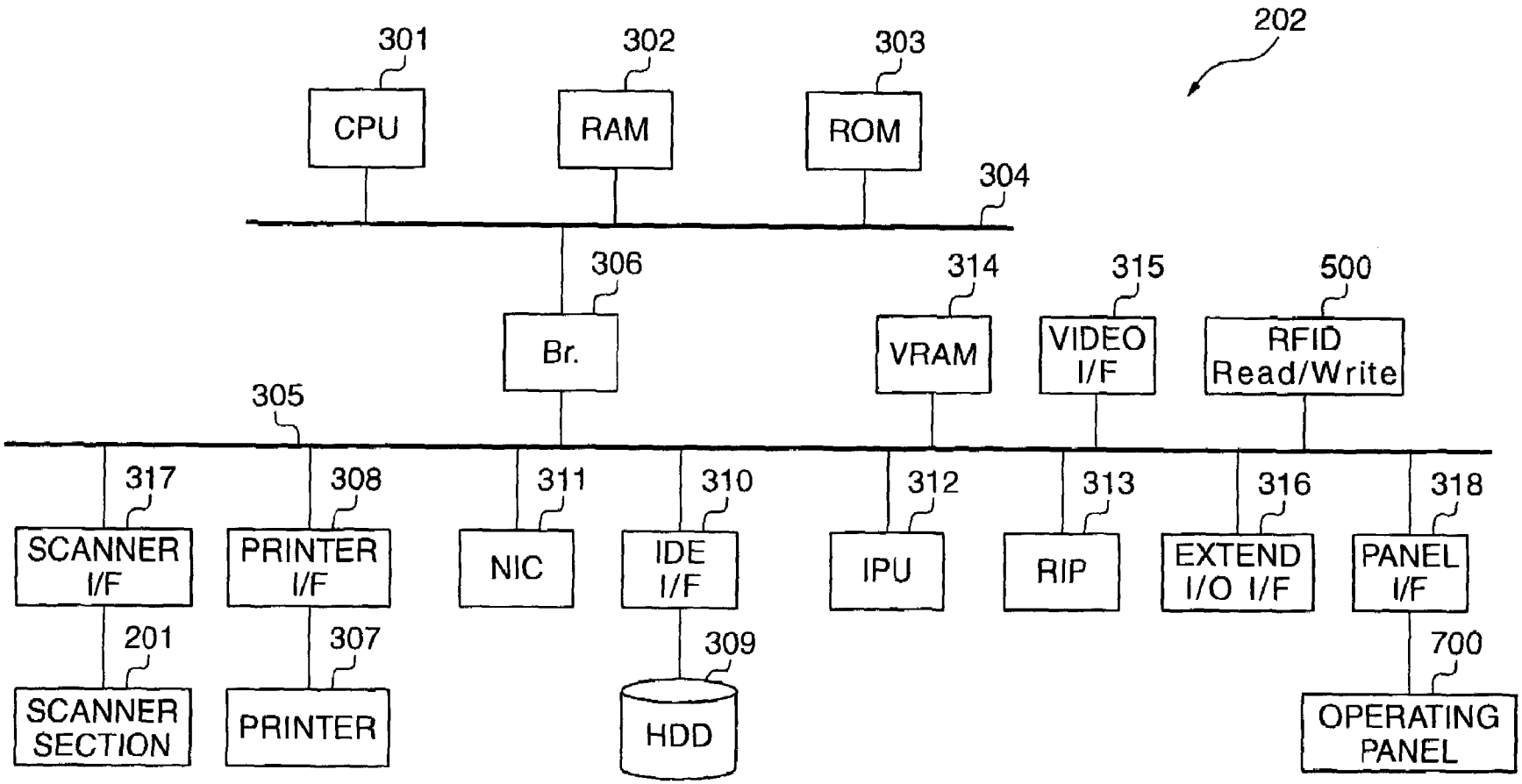
FIG. 6 is a block diagram showing the electrical construction of a printer unit appearing in FIG. 2.

FIG. 6 is a block diagram showing the electrical construction of the printer section 202 in FIG. 2. The printer section 202 includes a local bus 304 and an I/O bus 305 connected to each other via a bridge circuit 306. Well-known components such as a CPU 301, a RAM 302, and a ROM 303 are connected to the local bus 304. The I/O bus 305 is an internal bus for extensions. Connected to the I/O bus 305 are a printer interface 308, an IDE interface 310, a network interface controller (NIC) 311, an image processing unit (IPU) 312, a raster image processor (RIP) 313, a video RAM (VRAM) 314, a video interface 315, an expansion I/O interface 316, a scanner interface 317, a panel interface 318 and an IC tag reader/writer (RFID Read/Write) 500.

The CPU 301 controls respective components of the printer section 202. The RAM 302 temporarily stores results of computations by the CPU 301, image data handled by the printer section 202, and other data. The ROM 303 stores programs to be executed by the CPU 301, font data required for generation of image data, and others.

The printer unit 307 forms an image on a recording medium such as a paper sheet, and can perform printing according to electrophotography, Bubble Jet (registered trademark), or the like. The printer interface section 308 provides connection between the printer unit 307 and the I/O bus 305, and can transfer image data stored in the RAM 302 to the printer unit 307 according to an instruction from the CPU 301. A hard disk drive (HDD) 309 is connected to the I/O bus 305 via the IDE interface 310, and performs spooling of image data and stores programs to be executed by the CPU 301, and others.

The network interface controller (NIC) 311 is used to connect the printer section 202 to the network 14. The image processing unit (IPU) 312 performs image processing such as resolution conversion. The raster image processor (RIP) 313 expands image data from image data written in a page description language externally supplied via the NIC 311 into a bitmap image according to an instruction from the CPU 301, and stores the bitmap image into RAM 302.

The video RAM 314 has loaded thereinto display data to be displayed on an external CRT or LCD panel by the CPU 301. The video interface 315 is used to display the display data stored in the VRAM 314 on the external CRT or LCD panel. The expansion I/O interface 316 is an interface circuit used for the CPU 301 to perform communication with, for example, a portable device or the like. The communication method includes a serial communication interface, a bidirectional Centronics interface, or a wireless communication method such as Bluetooth. The IC tag reader/writer 500 reads and writes data from and into the contactless IC (RFID) 600 by wireless communication therebetween.

The operating panel 700 is connected to the I/O bus 305 via the panel interface 318. Further, the image reader section 201 is connected to the I/O bus 305 via the scanner interface 317.

(Electrical Construction of IC Tag Reader/Writer 500)

Figure 7:
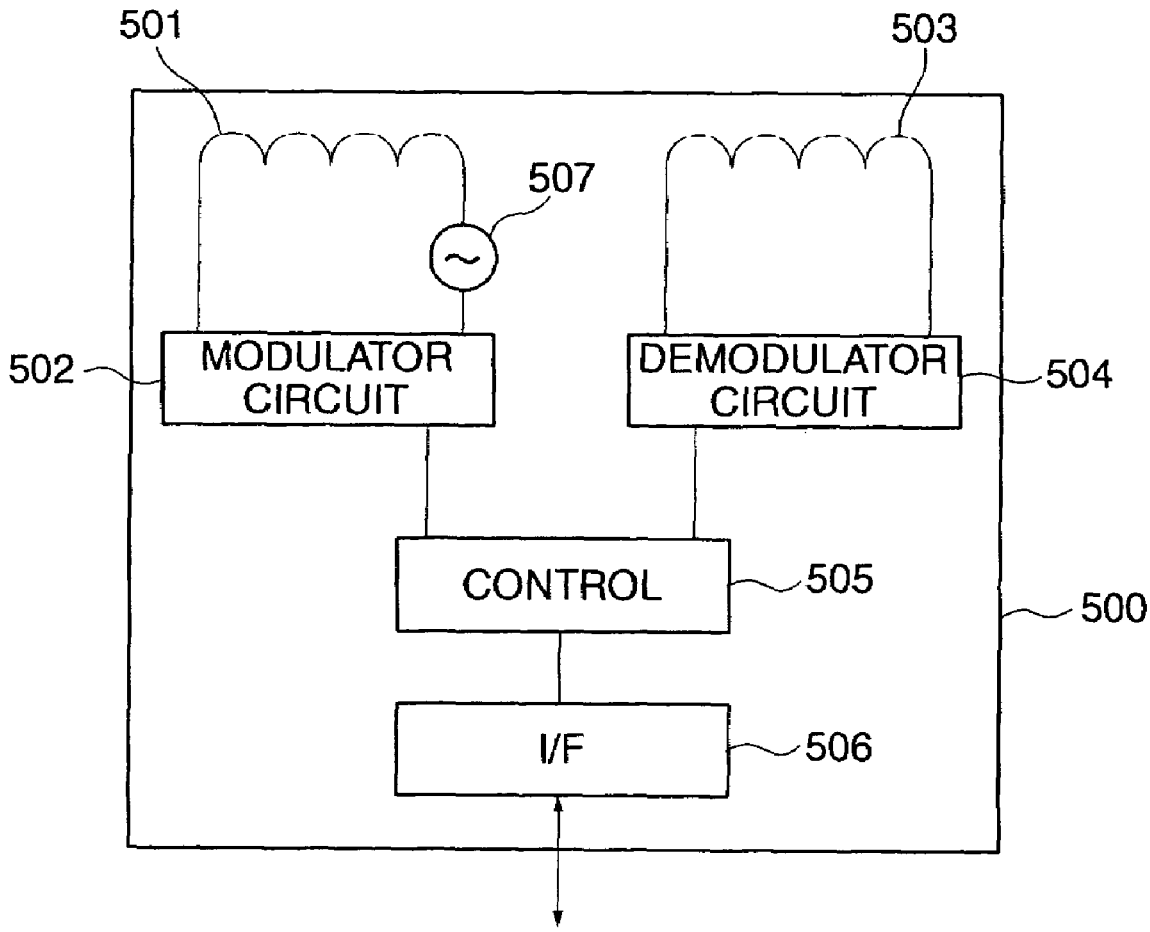
FIG. 7 is a block diagram showing the electrical construction of an IC tag reader/writer appearing in FIG. 1.

FIG. 7 is a block diagram showing the electrical construction of the IC tag reader/writer 500 in FIG. 1. The IC tag reader/writer 500 reads and writes data from and into the contactless IC (RFID) 600, described below, by wireless communication therebetween and is comprised of a transmitting antenna section 501, a modulator circuit 502, a receiving antenna section 503, a demodulator circuit 504, a control section 505, an interface section 506, and a power supply 507.

The transmitting antenna section 501 transmits radio wave signals to the contactless IC 600. The modulator circuit 502 modulates radio wave signals to be transmitted from the transmitting antenna section 501. The receiving antenna section 503 receives radio wave signals sent from the contactless IC 600. The demodulator circuit 504 demodulates a signal received from the receiving antenna section 503. The interface section 506 communicates with a host apparatus. The power supply 507 is connected to the transmitting antenna section 501 to supply power to the contactless IC 600.

The control section 505 controls the transmitting antenna section 501, the modulator circuit 502, the receiving antenna section 503, and the demodulator circuit 504. Further, the control section 505 operates in response to an external instruction to cause the modulator circuit 502 to modulate radio wave signals for supplying electric power and for transmitting IC tag data and cause the transmitting antenna section 501 to transmit these radio wave signals to an external device. Further, the control section 505 causes the receiving antenna section 503 to receive a radio wave signal from an external device, causes the demodulator circuit 504 to demodulate the received radio wave signal, and then can convert the demodulated signal so that the converted signal can be handled as a data signal.

(Electrical Construction of Contactless IC 600)

Figure 8:
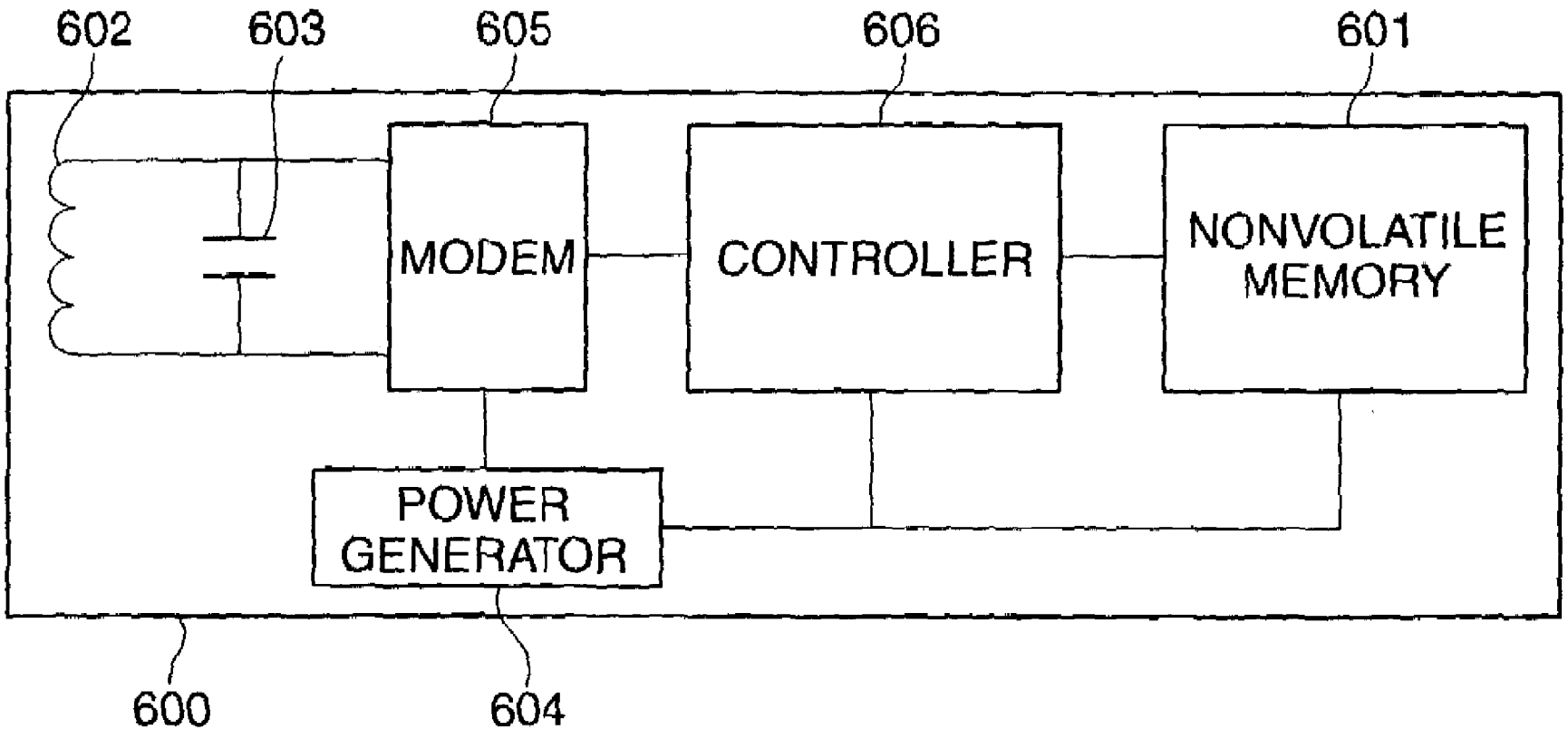
FIG. 8 is a block diagram showing the electrical construction of a contactless IC in FIG. 1.

FIG. 8 is a block diagram showing the electrical construction of the contactless IC 600. The contactless IC 600, which is incorporated in the respective authentication tags (ID cards) 101 to 103, is comprised of a nonvolatile memory 601, an antenna section 602, a resonant capacitor section 603, a power generating section 604, a demodulator/modulator section 605, and a control section 606.

The antenna section 602 transmits and receives radio wave signals, and is combined with the resonant capacitor section 603 to form a resonant circuit. The power generating section 604 rectifies and smoothes externally supplied power. The demodulator/modulator section 605 demodulates and modulates the radio wave signals. When the radio wave signal for supplying power is externally supplied, the radio wave signal is received by the above-mentioned resonant circuit, which supplies the power to the power generating section 604. In this way, the power generating section 604 can supply power required for the operation of the contactless IC 600. This power is supplied to the nonvolatile memory 601 and the demodulator/modulator section 605.

The control section 606 controls the entire contactless IC 600. While radio wave signals for externally supplying power are received, data read from or written into the IC 600 is also transmitted or received at the same time. The data signal transmitted to the contactless IC 600 is demodulated by the demodulator/modulator section 605, and then the data is stored by the control section 606 in the nonvolatile memory 601. Data read out by the control section 606 from the nonvolatile memory 601 is modulated by the demodulator/modulator section 605 and then transmitted as a radio wave signal from the antenna section 602.

(Recovery Operation of Copy Machine 200)

A description will be given of the operation of returning from the sleep mode of the copying machine 200 of the image forming system 100 having the above described configuration. The ROM 303 in the copying machine 200 stores a matrix table used in returning from the sleep mode. FIG. 9 is a diagram showing the matrix table showing conditions for the copying machine to return from the sleep mode. According to the matrix table, the copying machine 200 can return from the sleep mode only in the case where the result of the user authentication indicates "permitted to use", and the detection result of the user operation indicates "operated".

Figure 10:
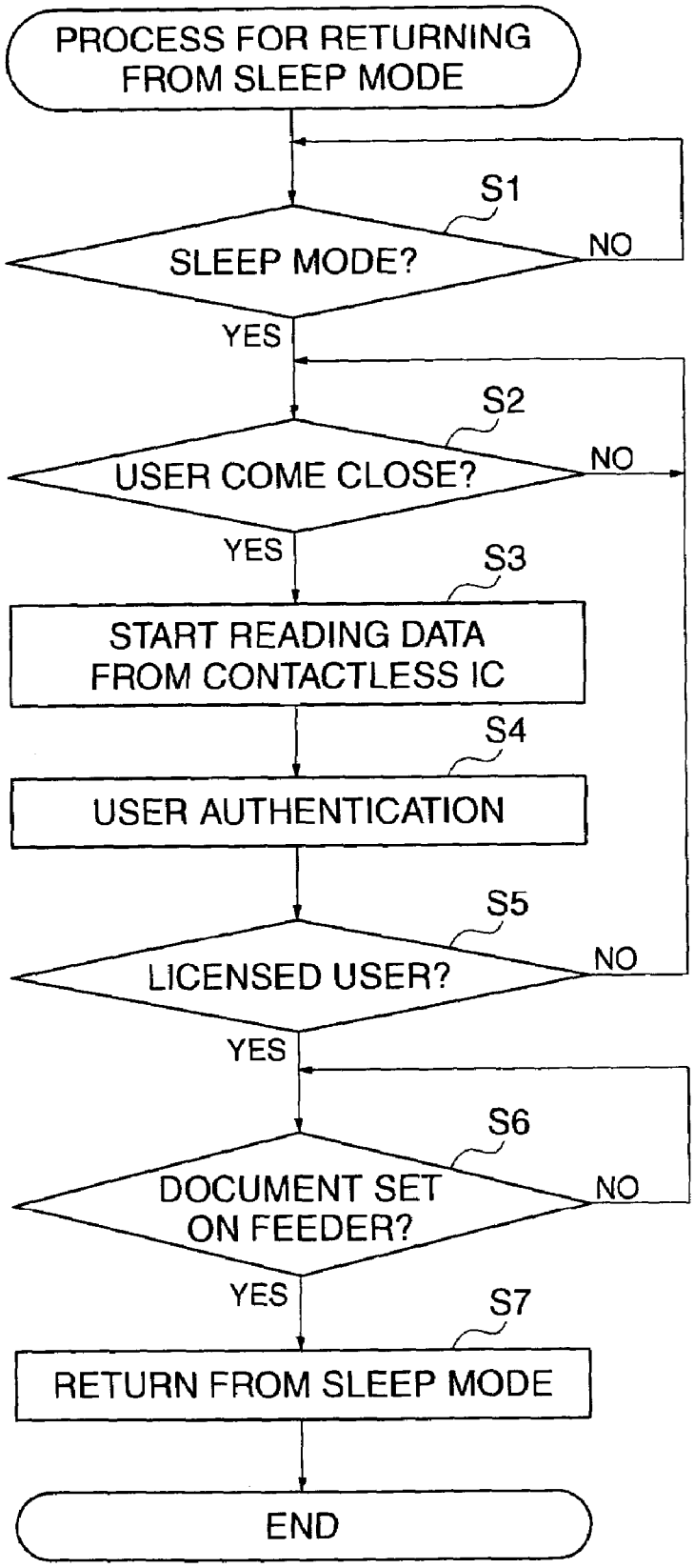
FIG. 10 is a flowchart showing a process for returning from the sleep mode, executed by the copying machine.

FIG. 10 is a flowchart showing a process for returning from the sleep mode, executed by the copying machine 200. A program for executing this process is stored in the ROM 303 of the printer section 202, and is executed by the CPU 301. First, it is determined whether or not the copying machine 200 is in the sleep mode (step S1). If not in the sleep mode, the CPU 301 waits until the copying machine 200 enters the sleep mode. If the copying machine 200 is in the sleep mode, it is detected whether or not a user has come near to the copying machine 200 (step S32). If not, the CPU 301 waits until a user has come near.

To determine whether or not a user has come near, the CPU 301 determines whether or not any of the authentication tag 101 to 103 owned by users is near the copying machine 200. As mentioned above, each authentication tag 101 to 103 has a contactless IC 600 incorporated therein. If a user carrying such an authentication tag passes by the copying machine 200, that is, if a contactless IC 600 is present within the range of radio wave signals emitted from the IC tag reader/writer 500, then it is made possible to communicate between the IC tag reader/writer 500 and the contactless IC 600. Hence, the CPU 301 will receive an interrupt signal from the IC tag reader/writer 500 indicative of the communication being possible and thereby determine that a user has come near.

When determining that the user has come near, the CPU 301 gives a read request to the IC tag reader/writer 500 connected to the I/O bus 305 for access to the memory in the contactless IC 600. When the contactless IC 600 responds to the read request, the CPU 301 starts to read user information (data) from the contactless IC 600 (step S3).

Having completed reading the data from the contactless IC 600, the CPU 301 executes user authentication (step S4). In executing the user authentication, the CPU 301 compares the user information acquired in the step S3 and temporarily stored in the RAM 302 with definition information indicative of whether or not it is permitted to use the copying machine on user-by-use basis, which is stored in the ROM 303 in advance.

Based on the result of the user authentication in the step S4, it is determined whether or not the user is permitted to use the copying machine 100, that is, a licensed (authorized) user (step S5). If the user is not a licensed user, the CPU 301 returns to the step S2. On the other hand, if the user is a licensed user, the CPU 301 proceeds to a step S6.

Then, it is determined whether or not an original document has been set the automatic feeder 800 (step S6). In the case where the user uses the automatic feeder 800 to make a copy, when an original document is set, the CPU 401 of the image reader section 201 sends a document set signal from the document set sensor 540 provided in the automatic feeder 800 to the printer section 202 of the copying machine 200 to notify the CPU 301 of the user's will to operate the copying machine with which the user "has set an original document on the automatic feeder 800". Upon receiving the document set signal, the CPU 301 obtains the detection information indicative of the user's operation, that is, indicating "the user has set an original document on the automatic feeder 800".

If it is determined in the step S6 that no original document has been set the automatic feeder 800, the CPU 301 waits until an original document is set. When an original document is set, the CPU 301 causes the copying machine 200 to return to the normal mode as the normal power consumption state from the sleep mode (step S7). Here, the result of the user authentication in the step S5 indicates "licensed" and the detection result of the user's operation in the step S6 indicates "operated", the CPU 301 refers to the above-mentioned matrix table in FIG. 9, and performs the process for returning from the sleep mode. Specifically, the CPU 301 turns on the power supply of the copying machine 200, which has been off. When the power supply is turned on, the return from the sleep mode is completed, and the CPU 301 terminates the present process.

(Operation of Contactless IC 600)

Figure 11:
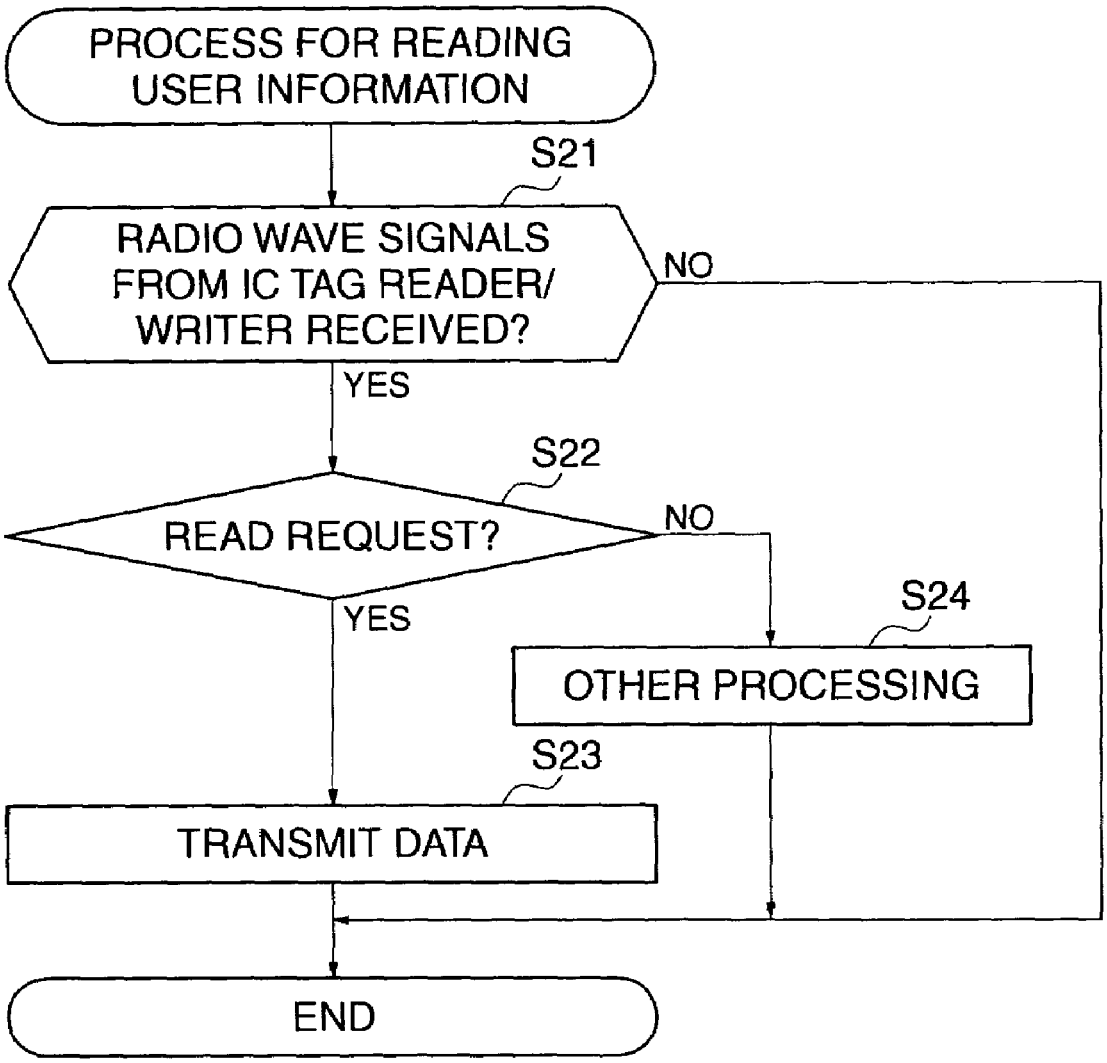
FIG. 11 is a flowchart showing a process for reading user information, executed by a tag IC.

FIG. 11 is a flowchart showing a process for reading user information, executed by the contactless IC 600. A program for executing this process is stored in the ROM of the control section 606, and is repeatedly executed by a CPU in the control section 606 at predetermined time intervals.

First, it is determined whether or not radio wave signals emitted from the IC tag reader/writer 500 have been received, that is, whether or not a user carrying the contactless IC 600 has come near to the copying machine 200 (step S21). If no radio wave signals emitted from the IC tag reader 500 have been received, the present process is immediately terminated.

On the other hand, if a user carrying the contactless IC 600 has come near to the copying machine 200 and radio wave signals emitted from the IC tag reader/writer 500 have been received, it is further determined whether or not a read request from the IC tag reader/writer 500 has been received (step S22). If the read request has been received, the user information registered in advance in the nonvolatile memory 601 is read out, and transmitted to the IC tag reader/writer 500 via the antenna section 602 (step S23) Then, the present process is terminated. If no read request has been received in the step S22, the CPU performs processing corresponding to an instruction other than the read request (step S24). For example, if the instruction is a write command for some data, the CPU writes the data into the nonvolatile memory 601. Then, the present process is terminated. If no instruction has been received, the present process is immediately terminated.

As described above, according to the first embodiment, the user's will to operate the copying machine 200 is confirmed based on not only the fact that the user has come near to the copying machine 200, but also the additional fact that the user has set an original document on the automatic feeder 800, and after the confirmation, the copying machine 200 is caused to return to the normal mode from the sleep mode. As a result, the copying machine 200 is can be returned from the sleep mode only when a user is sure to use the same.

Next, a second embodiment of the present invention will be described.

The image forming system according to the second embodiment including a copying machine and authentication tags is identical in configuration to the first embodiment described above. The same elements and parts are designated by like reference numerals, and duplicated description thereof is omitted. The second embodiment include confirming means for confirming the user's will to operate the copying machine by detecting that the operating panel 700 has been pressed or operated, instead of detecting that an original document has been set the automatic feeder 800.

Figure 12:
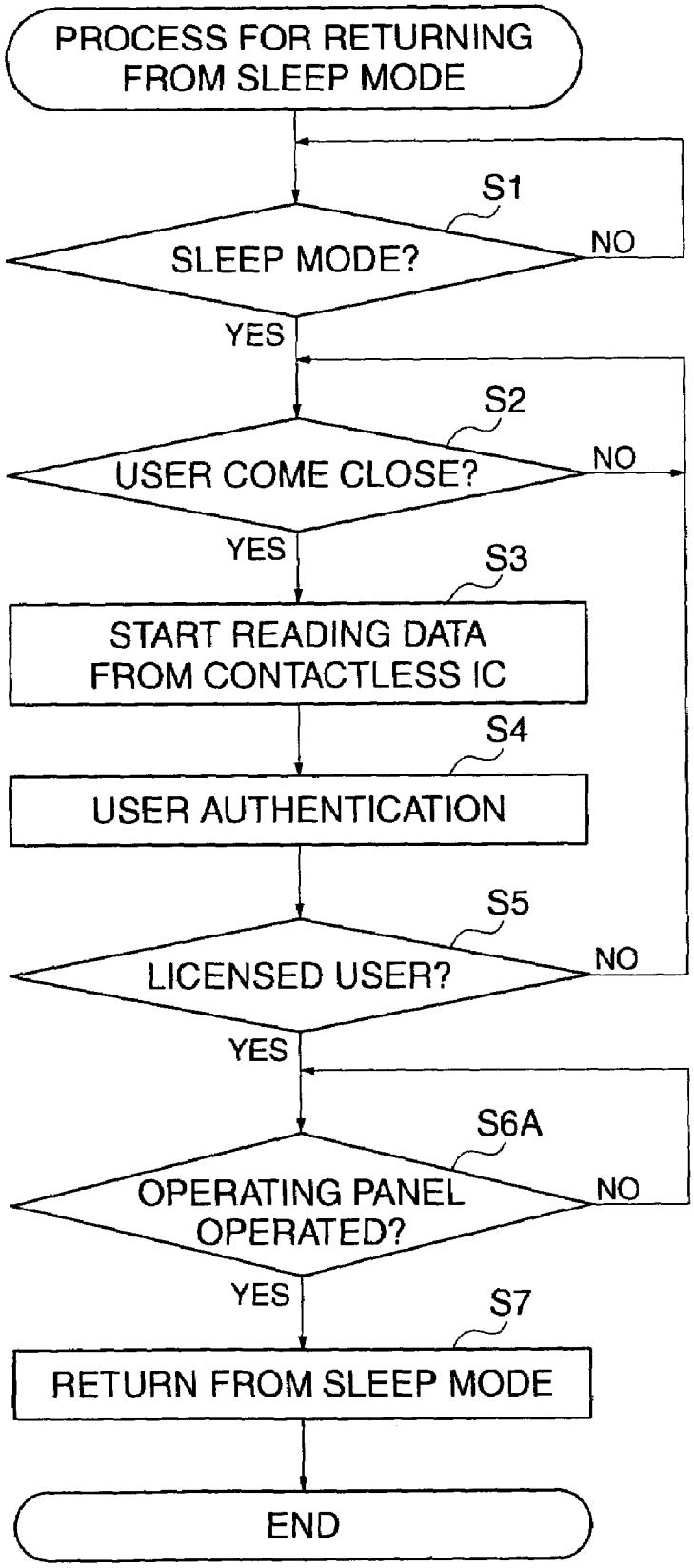
FIG. 12 is a flowchart showing a process for returning from the sleep mode, executed by a copying machine as an image forming apparatus according to a second embodiment of the invention.

FIG. 12 is a flowchart showing a process for returning from the sleep mode, executed by the copying machine 200 of the second embodiment. A program for executing this process is stored in the ROM 303 of the printer section 202, and executed by the CPU 301. The same process steps to those in the first embodiment are designated by like step numbers.

First, it is determined whether or not the copying machine 200 is in the sleep mode (step S1). If not in the sleep mode, the CPU 301 waits until the copying machine 200 enters the sleep mode. If the copying machine 200 is in the sleep mode, the CPU 301 detects whether or not a user has come near to the copying machine 200 (step S32). If not, the CPU 301 waits until a user has come near. On the other hand, if it is determined that a user has come near, the CPU 301 gives a read request to the IC tag reader/writer 500 for access to the memory of the contactless IC 600. When the contactless IC responds to the read request, the CPU 301 starts to read user information (data) from the contactless IC 600 (step S3).

Upon completion of reading the data from the contactless IC 600, the CPU 301 executes user authentication (step S4). Based on the result of the user authentication in the step S4, it is determined whether or not the user is a licensed (authorized) user (step S5). If the user is not a licensed user, the CPU 301 returns to the step S2. On the other hand, if the user is a licensed user, it is determined whether or not the operating panel 700 has been operated (step S6A). In the case where the user uses the automatic feeder 800 to make a copy, when the operating panel 700 is operated, a panel operation signal is sent to the CPU 301 in the copying machine 200 to notify the CPU 301 of the user's will to operate the copying machine with which the user "has set parameters for copying with the operating panel 700". Upon receiving the panel operation signal, the CPU 301 obtains the detection information indicative of the user's operation of the operating panel 700, that is, indicating that the user has operated the operating panel 700.

If the operating panel 700 has not been operated in the step S6A, the CPU 301 waits until the operating panel 700 is operated. When the operating panel 700 is operated, the CPU 301 controls the copying machine 200 to return to the normal mode from the sleep mode (step S7). Then, the present process is terminated.

As described above, according to the second embodiment, the user's will to operate the copying machine is confirmed based on not only the fact that the user has come near to the copying machine 200, but also the additional fact that the user has operated the operating section, and after the confirmation, the copying machine 200 is caused to shift to the normal mode from the sleep mode. As a result, the copying machine 200 can be shifted from the sleep mode only when a user is sure to use the same.

In the above described embodiments, the IC tag reader/writer 500 is in an energized state to monitor whether any contactless IC 600 is present within the range of radio waves emitted from the IC tag reader/writer 500 even when the copying machine is in the sleep mode. Alternatively, the automatic feeder 800 and/or the operating panel 700 may be put into an energized state only when the user is determined to be a licensed user as a result of the user authentication.

In the above embodiments, after the user authentication is carried out, the user's will to operate the copying machine is confirmed. Alternatively, it may be configured such that after the user's will to operate is confirmed, the user authentication is carried out to return the copying machine from the sleep mode.

Specifically, in the first embodiment, when the answer to the step S1 is affirmative (YES), it is determined whether or not an original document has been set on the automatic feeder 800 (step S6). If the answer to the step S6 is affirmative (YES), it is determined whether or not any of the authentication tags 100 to 103 owned by the respective users has come near to the copying machine 200 (step S2). Thereafter, as is the case with the process of FIG. 10, user authentication is carried out (step S4), and then it is determined whether or not the user is a licensed user (step S5). If the answer to the step S5 is affirmative (YES), the copying machine 200 is returned to the normal mode as the normal power consumption state (step S7).

It should be noted that when the answer to the step S1 is negative (NO), the step S1 is repeated, and if the answer to the step S6 is negative (NO), the step S6 is repeated. If the answer to the step S2 is negative (NO) and the answer to the step S5 is negative (NO), the step S2 is repeated.

In the second embodiment, instead of determining whether or not an original document has been set on the automatic feeder 80 as in the first embodiment (step S6), it is determined whether or not the operating panel 700 has been operated (step S6A). Thereafter, the steps S2 to S5 are executed. If the answer to the step S5 is affirmative (YES), the copying machine 200 is returned from the sleep mode to the normal mode as the normal power consumption state (step S7).

In this way, even when execution of the user authentication follows the confirmation of the user's will to operate the copying machine, the same effects can be provided.

In this case, the automatic feeder 800 and the operating panel 700 are kept in the energized state even during the sleep mode. It may be configured such that the IC tag reader/write 500 is put into the energized state only when an original document has been set on the automatic feeder 800 or when the operating panel 700 has been operated.

In either case, it is possible to cause the copying machine to gradually return from the sleep mode, to thereby enhance energy saving efficiency without spoiling userfriendliness.

The present invention is not limited to the above described embodiments and can be applied to any configuration insofar as it can accomplish the functions recited in the appended claims or the functions of the configuration of either of the above described embodiments. For example, although in the above embodiments, the user's will to operate the copying machine is confirmed by detecting the fact that an original document is set or the fact that the operating panel 700 has been operated, it may be confirmed that a user has the will to operate the copying machine by detecting the fact that the user carrying one of the authentication tags 101 to 103 has been staying within the range of radio wave signals emitted from the IC tag reader/writer 500 for more than a predetermined period of time. In this case, the user's will can be confirmed by measuring a period of time elapsed after the IC tag reader/writer 500 starts communication with the contactless IC 600. Alternatively, a button operable by users may be provided on each of the authentication tags 101 to 103, and the user's will to operate the copying machine may be confirmed by detecting the fact that the button has been pressed or operated.

Although in the above described embodiments, the copying machine shifts to a single normal mode from the sleep mode, the copying machine may be turned to two or more modes. For example, in the case where there are provided a first shift mode in which the use of a printer section of a copying machine is restricted so that the printer section has to be used as a scanner alone, and only a scanner section of the printer section is shifted to a normal mode but the printer section is kept in a sleep mode, and a second shift mode in which both the scanner section and the printer section are shifted to the normal mode, one of the first and second shift modes can be selected depending on settings of an operating section.

Further, the time period required for shifting from the sleep mode can be shortened by using the surface rapid (SURF) fixing or the induction heating (IH) fixing, or by pre-adjusting the temperature of the fixing device. Although in the above embodiments, the image forming apparatus is applied to a copying machine as a multifunction peripheral (MFP), the present invention is not limited to a copying machine, and can also be applied to a printer or the like. Although in the above embodiments, an automatic feeder is provided on an upper portion of the copying machine, the present invention can also be applied to a configuration that a scanner with an automatic feeder is provided on an upper portion of the copying machine.

Further, the present invention may either be applied to a system composed of a plurality of apparatuses or to a single apparatus.

It is to be understood that the object of the present invention may also be accomplished by supplying a system or an apparatus with a storage medium in which a program code of software which realizes the functions of either of the above described embodiments is stored, and causing a computer (or CPU or MPU) of the system or apparatus to read out and execute the program code stored in the storage medium.

In this case, the program code itself read from the storage medium realizes the functions of either of the above described embodiments, and hence the program code and the storage medium on which the program code is stored constitute the present invention.

Examples of the storage medium for supplying the program code include a ROM, a floppy (registered trademark) disk, a memory card such as PCMCIA card or compact flash (registered trademark), a hard disk, a micro DAT, a magnet-optical disk, an optical disk such as CD-R or CD-RW, and a phase-change optical disk such as DVD. The program code may also be downloaded via a network.

Further, it is to be understood that the functions of either of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of either of the above described embodiments may be accomplished by writing the program code read out from the storage medium into a memory provided on an expansion board inserted into a computer or a memory provided in an expansion unit connected to the computer and then causing a CPU or the like provided in the expansion board or the expansion unit to perform a part or all of the actual operations based on the instructions of the program code.

CROSS REFERENCE TO RELATED APPLICATION

This application claims priority from Japanese Patent Application No. 2004-229491 filed Aug. 5, 2004, which is hereby incorporated by reference herein.

What is claimed is:

1. An image forming apparatus that controls shift from a reduced power consumption state, comprising:

a presence detecting unit that detects whether or not a portable information storage unit is present within a predetermined range;

an information reading unit that is operable when the portable information storage unit is present within the predetermined range, to communicate with the portable information storage unit to read information stored in the portable information storage unit;

a measuring unit that measures a period of time for which said presence detecting unit detects that the portable information storage unit is present within the predetermined range; and a control unit that causes the image forming apparatus to shift from the reduced power consumption state to a normal power consumption state in the case where the period of time measured by said measuring unit reaches a predetermined period of time.

2. An image forming apparatus as claimed in claim 1, further comprising an authentication unit that executes authentication of the user based on the read information, wherein the control unit causes the image forming apparatus to shift from the reduced power consumption state to the normal power consumption state when the user is authenticated.

3. An image forming apparatus as claimed in claim 1, further comprising an operation detecting unit that detects the user's operation of the image forming apparatus based on a predetermined action of the user, and wherein the control unit causes the image forming apparatus to shift from the reduced power consumption state to the normal power consumption state when the user's operation of the image forming apparatus is detected.

4. An image forming apparatus as claimed in claim 1, further comprising an authentication unit that executes authentication of the user based on the read information, and an operation detecting unit that detects the user's operation of the image forming apparatus based on a predetermined action of the user, and wherein the control unit causes the image forming apparatus to shift from the reduced power consumption state to the normal power consumption state when the user is authenticated and the user's operation of the image forming apparatus is detected.

5. An image forming apparatus as claimed in claim 4, wherein said control unit causes the image forming apparatus to shift from the reduced power consumption state to the normal power consumption state by using a table indicating control contents corresponding to results of the authentication of the user and results of the detection of the user's operation.

6. An image forming apparatus as claimed in claim 4, further comprising a document feeder that feeds an original document to a read position, said document feeder having a tray, and wherein said operation detecting unit confirms the user's operation when detecting that the original document has been set on the tray of said document feeder.

7. An image forming apparatus as claimed in claim 4, further comprising an input unit that inputs a user's operation, and wherein said operation detecting unit confirms the user's operation when detecting that an operation by the user has been input by said input unit.

8. A control method of controlling shift of an image forming apparatus from a reduced power consumption state, comprising:

detecting whether or not a portable information storage unit is present within a predetermined range;

communicating with the portable information storage unit to read information stored in the portable information storage unit when the portable information storage unit is present within the predetermined range;

measuring a period of time for which the portable information storage unit is present within the predetermined range; and causing the image forming apparatus to shift from the reduced power consumption state to a normal power consumption stat in the case where the measured period of time reaches a predetermined period of time.

9. A storage medium storing a computer-readable program code that realizes the control method as claimed in claim 8.

10. A program comprising a computer readable program code that realizes the control method as claimed in claim 8.

11. An image forming system comprising an image forming apparatus and a portable information storage unit, that communicates with said imaging forming apparatus, the image forming system controlling shift of said image forming apparatus from a reduced power consumption state, and wherein said image forming apparatus comprises:

a presence detecting device that detects whether or not said portable information storage unit is present within a predetermined range;

an information reading device that communicates with said portable information storage unit to read information stored in said portable information storage unit when said portable information storage unit is present within the predetermined range;

a measuring device that measures a period of time for which said presence detecting device detects that the portable information storage unit is present within the predetermined range; and a control device that causes the image forming apparatus to shift from the reduced power consumption state to a normal power consumption state in the case where the period of time measured by said measuring device reaches a predetermined period of time, and wherein said portable information storage unit comprises:

an information storage device that stores information therein; and a transmitting device that communicates with said image forming apparatus to transmit the stored information to said image forming apparatus.

* * * * *